United States Patent [19]

Paradis

[11] Patent Number: 4,704,794

[45] Date of Patent: Nov. 10, 1987

[54] SUCTION TYPE HAIR CLIPPER

[76] Inventor: Benoit Paradis, 1164 Bagot Street, Longueuil, Canada, J4M 1E3

[21] Appl. No.: 750,157

[22] Filed: Jul. 1, 1985

[51] Int. Cl.[4] ..... B26B 19/20

[52] U.S. Cl. ..... 30/133; 30/132/201

[58] Field of Search ..... 30/30, 132, 133, 201

[56] References Cited

U.S. PATENT DOCUMENTS

| | | | |
|---|---|---|---|
| 2,517,999 | 8/1950 | Giorgi | 30/201 |
| 2,722,741 | 11/1955 | McAuliffe | 30/201 |
| 2,807,086 | 12/1955 | Watkins | 30/133 |
| 2,914,849 | 5/1958 | Watkins . | |
| 2,929,140 | 9/1957 | Wilson . | |
| 2,975,517 | 10/1959 | Brittain . | |
| 3,208,143 | 9/1965 | Suozzi | 30/201 |
| 3,368,277 | 2/1968 | Ve Vea . | |
| 3,505,732 | 4/1970 | Ditrapani | 30/133 |

FOREIGN PATENT DOCUMENTS

| | | | |
|---|---|---|---|
| 1051187 | 3/1979 | Canada . | |
| 1059305 | 7/1979 | Canada . | |
| 2400414 | 4/1979 | France | 30/133 |

*Primary Examiner*—E. R. Kazenske
*Assistant Examiner*—Michael D. Folkerts
*Attorney, Agent, or Firm*—Pierre Lesperance

[57] ABSTRACT

The hair clipper comprises a hollow hand-carriable casing having an outlet adapted to be connected to a vacuum source, such as a domestic vacuum cleaner, and an intake adapted to be applied to the scalp to draw the hair into the casing. A stationary blade and a pivoted cutting blade are located just inside the intake. An air turbine, actuated by the air stream moving through the casing, drives the pivoted blade in a scissor-like reciprocating movement to cut the hairs and remove them by suction. Intake extensions of various lengths and shapes are removably attached to the casing to vary the length of the uncut hair.

7 Claims, 16 Drawing Figures

Fig. 1
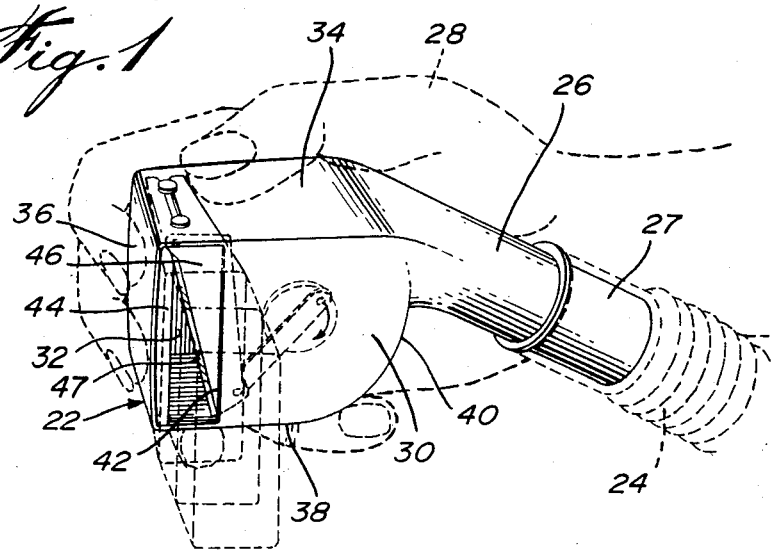
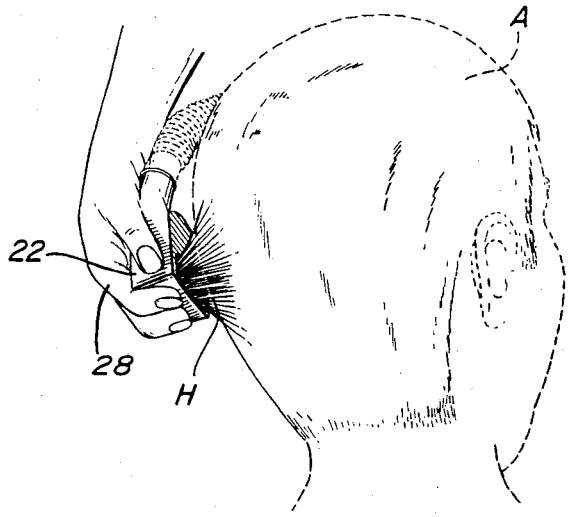
Fig. 2

SUCTION TYPE HAIR CLIPPER

FIELD OF THE INVENTION

This invention relates to hair-cutting devices and, more particularly, to a suction type hair-cutter.

BACKGROUND OF THE INVENTION

Suction type hair cutters are known in the art. They are useful in that they allow an unskilled person to cut hair at home or elsewhere, and in that they prevent the hair from falling on the floor and being scattered thereover. In some of these known devices, the hair clipper includes a conventional electrically-operated electric razor at one end to cut the hairs as they are drawn within the hair clipper casing by the suction source. The length of the hair to be left uncut can also be varied by incremental outer displacement of the suction end of the hair clipper. In other known suction type hair clippers, an air-driven turbine drives a reciprocating blade which is mounted parallel to and contiguous to a stationary blade (see, for instance, U.S. Pat. No. 2,929,140 dated Mar. 22, 1960 to S. B. Wilson and entitled: ACCESSORY FOR BARBER TOOLS). However, the latter type of such hair clippers hss failed to cut long hair, due to the shortness of the cutting teeth, and they also have the tendency to jam, since the play between the parallel blades is so small that uncut hair can engage therebetween.

OBJECTS OF THE INVENTION

The main object of the present invention is to provide a suction type hair cutter having scissor-type cutting blades.

Another object of the present invention is to provide the above cutter with detachable intake extensions of various lengths and/or shapes, adapted to leave uncut hair of the desired length while still applying the extension against the scalp.

A further object of the invention is to provide a suction type hair cutter which will not become jammed by uncut hair extending between the blades.

SUMMARY OF THE INVENTION

The hair cutting device of the present invention includes a hand-carriable casing having an outlet adapted to be connected to a suction source and an intake adapted to be applied to the scalp to draw the hair into the casing. A stationary blade and a pivoted cutting blade are located in registry with the intake and just inwardly thereof. Means are provided to drive the pivoted blade in a scissor-like reciprocating movement to cut the hairs and remove them by suction. Preferably, intake extensions, of various lengths and/or shapes, are removably attached to the casing intake to vary the length of the uncut hair.

In accordance with an essential feature of the invention, the stationary and the pivoted blades define opposite longitudinal sides of the elongated intake, and the hair is sucked straight therebetween to be cut by scissor-like action, the pivoted blade sliding on the stationary blade. The pivoted blade is preferably driven by an air turbine located within tne casing and in turn driven by the air flowing through the casing.

BRIEF DESCRIPTION OF THE DRAWINGS

FIG. 1 is a perspective view of a hand in dotted lines holding the hair cutter in accordance with the first embodiment of the invention with its extension in dotted lines and shown connected to the suction hose (in dotted lines) of a home vacuum cleaner;

FIG. 2 is a perspective view, on a smaller scale, of the same hair cutter in the hand of a user as operated on a scalp, shown in dotted line;

DETAILED DESCRIPTION OF THE TWO PREFERRED EMBODIMENTS

Figure 3:
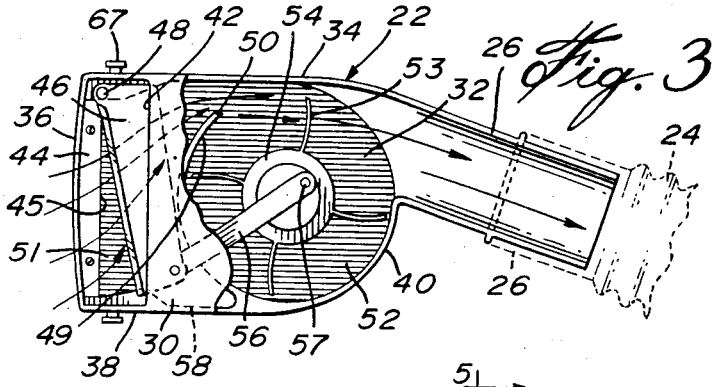
FIG. 3 is a side elevation, partially in longitudinal section, of the hair cutter and suction hose of FIG. 1, with the pivoted cutting blade in open position.
Figure 4:
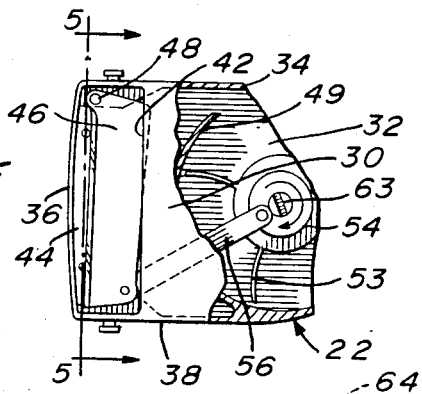
FIG. 4 is a partial view similar to that of FIG. 3 but showing the pivoted cutting blade in closed position.
Figure 5:
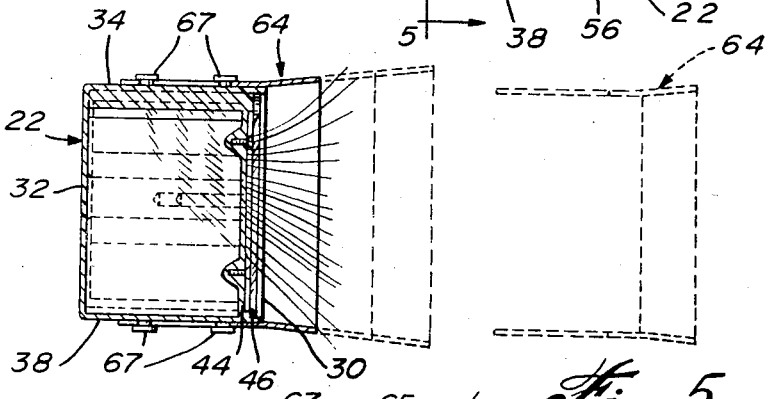
FIG. 5 is a cross-section taken along line 5—5 of FIG. 4.
Figure 8:
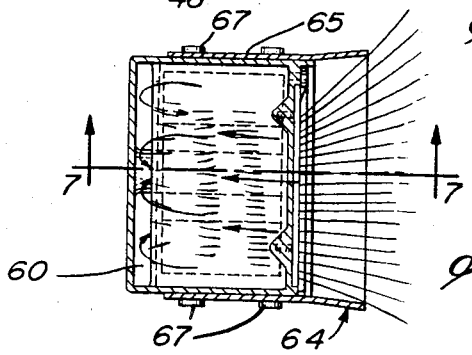
FIG. 8, seen on the second sheet of drawings, is a section taken along line 8—8 of FIG. 6.

Referring to FIGS. 1 to 5 inclusive, the hair clipper of the first embodiment comprises a casing 22 adapted to be connected to the outer end of a flexible suction hose 24, of a conventional vacuum source (not shown), such as a home vacuum cleaner. For this purpose, casing 22 has an outlet tube 26 adapted to be slidably inserted into the rigid nipple 27 attached to the outer end of suction hose 24. Casing 22 should be of such a size as to be handled with ease by a single hand 28 of a user. Casing 22 includes a flat front wall 30, a flat rear wall 32 parallel to and spaced from front wall 30, a flat top wall 34, a flat side wall 36 opposite to outlet tube 26, and a bottom wall 38 merging with a curved side wall 40. Outlet tube 26 communicates with the casing 22 at the junction of the top wall 34 with the curved side wall 40. A rectangular shape intake aperture 42 is formed in the front wall 30 adjacent side wall 36 and extends longitudinally between the top wall 34 and bottom wall 38. A fixed cutting blade 44 is fixed to the side wall 36 and extends practically tnroughout the distance between the top wall 34 and bottom wall 38. This blade 44 defines one long side of the rectangular intake aperture 42. This fixed blade 44 has a straight cutting edge 45. A pivoted blade 46, of generally rectangular shape with a straight cutting edge 47, is pivoted to the casing 22 at one upper corner thereof by means of a pivot pin 48. As shown in FIGS. 3 and 5, the pivoted blade 46 is slidably movable just behind the front wall 30 and is guided by the same. The straight cutting edge 47 of the pivoted blade 46 is adapted to overlap and to coact with the cutting edge 45 of the fixed blade 44 in a scissor-like action.

A curved transverse wall 49 extends between and joins with the front wall 30 and the rear wall 32 and joins at its bottom end with the bottom wall 38, but terminates short of the top wall 34 to leave a gap 50 with said top wall 34.

Curved wall 49 forms a partition within casing 22, which defines on the front side an entrance chamber 51 and on the rear concave side a partially cylindrical chamber 52 in conjunction with the curved wall 40. This cylindrical chamber 52 houses a coaxial turbine 53, the hub 54 of which is freely rotatable on a spindle 55 (FIG. 7) fixed to the rear wall 32. The turbine 53 turns in the clockwise direction (see FIG. 3) under the action of the air stream entering intake aperture 42; then entrance chamber 51 and passing through gap 50 to exit through outlet tube 26.

A crank arm 56 is eccentrically pivoted at 57 to the hub 54 and at 58 to the end of the pivoted blade 46 which is diagonally opposite to pivot pin 48. As shown in FIG. 2, upon operation of the vacuum source and application of the casing 22 on the scalp A of a person, the hairs H are drawn into the entrance chamber 51 through the intake aperture 42 and between the open pivoted blade 46 and fixed blade 44. The blade is reciprocated by the air turbine 53 to effect a scissor-like action and the cut hairs are drawn by the air stream through the gap 50 and into the hose 24.

Figure 6:
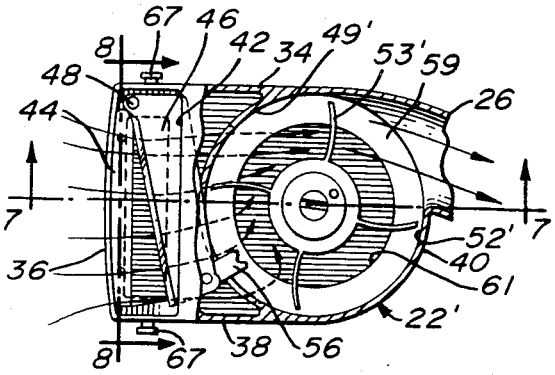
FIG. 6 (seen on the third sheet of drawings) is a partial side elevation in partial longitudinal section, similar to that of FIG. 3 but of a second embodiment.
Figure 7:
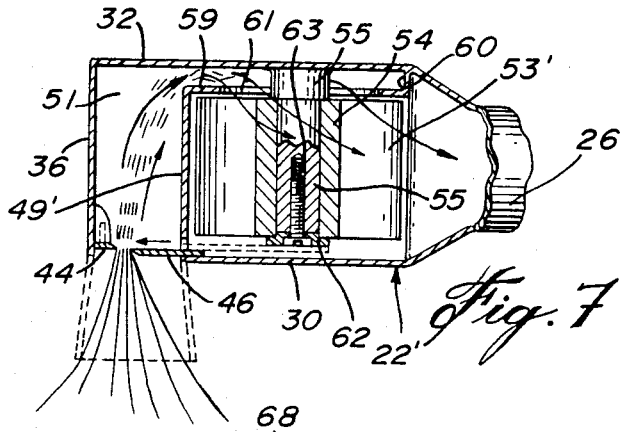
FIG. 7 is a plan section taken along line 7—7 of FIGS. 6 and 8.

FIGS. 6 and 7 show a modified embodiment in which the only difference with respect to FIG. 1 is in the manner of directing the air flow and the cut hairs through the turbine. In this embodiment, the air turbine 53' is of a width smaller than the distance between the front and rear walls 30 and 32 of the casing 22', and this turbine 53' is located between the front wall and a longitudinal partition wall 59 which defines, with the rear wall 32, a chamber 60 whith communicates with the turbine chamber 52' through a circular opening 61 made in partition 59 and coaxial with the spindle 55. Chamber 60 is in full communication with the entrance chamber 51. The transverse curved wall 49' extends from the front wall 30 to the partition 59 only but extends fully from the bottom wall 38 to the top wall 34, as clearly shown in FIG. 6.

Figure 9:
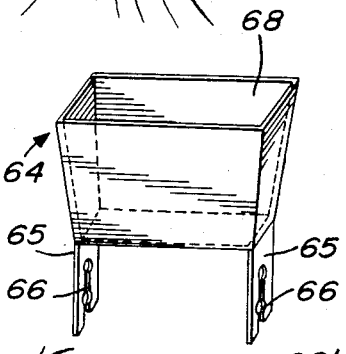
FIG. 9 is a perspective view of a removable extension to be used for either embodiment.
Figure 10:
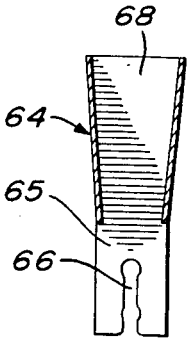
FIG. 10 is a cross-section of the extension of FIG. 9.

FIG. 7 further shows the turbine hub 54 freely rotatably mounted on the spindle 55 and is retained thereon by the washer 62 and screw 63. As in the first embodiment, the cut hairs are drawn into entrance chamber 51 but are sucked through the central portion of the turbine by going through circular opening 61. In both embodiments, an intake extension may be removably attached to the casing 22' 22', in register with the intake aperture 42. One embodiment of this intake extension is shown at 64 in FIGS. 9 and 10 and includes a flared duct, of rectangular cross-sectional shape, with lateral legs 65 provided with clip-type slots 66 adapted to removably receive headed studs 67 protruding from the top wall 34 and bottom wall 38 of the casing 22' 22', of either embodiment.

The extension 64 is preferably slightly flaring outwardly from the intake aperture 42 of the casing. Extension 64 may have different lengths, so as to selectively vary the length of uncut hair when the mouth 68 of the extension is applied against the scalp A. This is shown in dotted line in FIG. 5.

Figure 11:
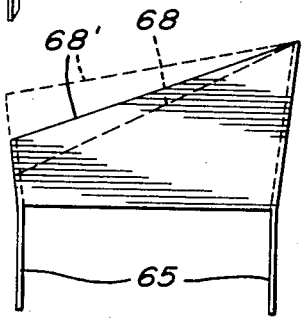
FIG. 11 is a side elevation of a removable extension showing various inclinations of the side walls thereof in phantom lines.

Intake extensions may have a mouth 68' of different inclinations, as shown in FIG. 11, so that when the mouth 68' is applied against the scalp, the cutting blades, which are held at a progressively-increased distance from the scalp, will leave uncut in a single pass hairs of progressive length.

Figure 16:
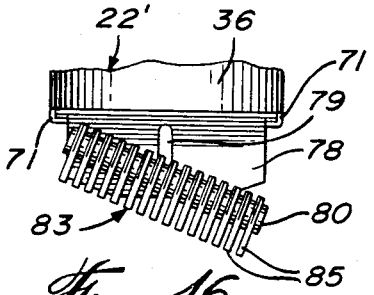
FIG. 16 is a partial front end assembly showing the comb-like extension in an inclined position, transversely of the hair-cutter casing.
Figure 15:
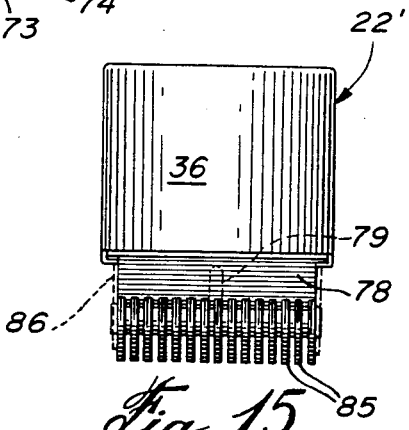
FIG. 15 is a front end elevation of the assembly shown in FIG. 13.

FIGS. 12 to 16 show still another embodiment of the intake extension, which is generally indicated at 70. The extension 70 is shown as applied to the embodiment of FIG. 7 but could be equally attached to the embodiment of FIG. 3. To the front wall 30 of the casing 22', are secured, longitudinally of the side edges of said front wall, a pair of channels 71 having oppositely-directed outside flanges which are provided with a series of indexing notches 72. A spring plate 73 extends against the outer face of wall 30 and within the respective channels 71; it has an inturned edge portion 74, normally engaging a selected one of a pair of transversely-registering notches 72. A pressure knob 75 is integrally attached to spring blade edge portion 74 by a blade portion 76, of smaller width than the distance between the two channels 71. Pressure applied against knob 75 will release the edge portion 74 from notches 72, so that the spring blade 73 can be moved along channels 71 to any selected position and the spring blade edge portion 74 will again engage another pair of notches 72 upon release of the pressure knob 75. Thus, the position of the extension can be selected in the direction of arrow 77, shown in FIG. 13. The end of spring blade 73, opposite pressure knob 75, forms a support 78 extending outwardly of the channels 71, clearing said channels and disposed at substantially right angle to the spring blade 73. This support portion 78 has an elongated slot 79, as shown in FIG. 16, which extends at right angle to front wall 30. A U-shape bracket 80 has a central button 81, the stem of which extends through slot 79 and the head of which overlies and frictionally engages the surface of the support 78, so that the bracket 80 can be adjusted up and down the support 78, as shown by arrow 82 in FIG. 12, and can be also transversely pivoted with respect to support 78, as shown in FIG. 16.

Figure 12:
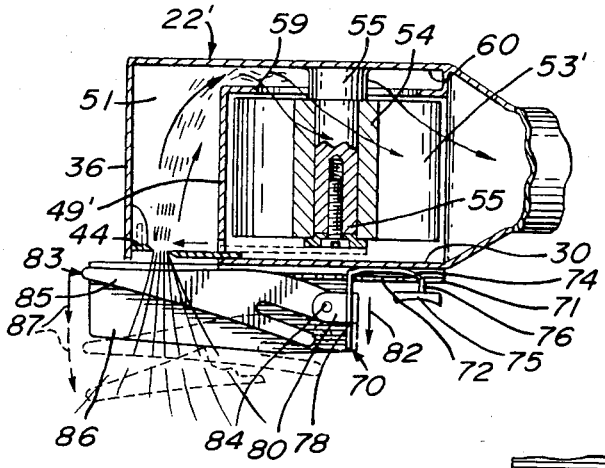
FIG. 12 is a view similar to that of FIG. 7 but showing another type of removable extension secured to the hair cutter.
Figure 13:
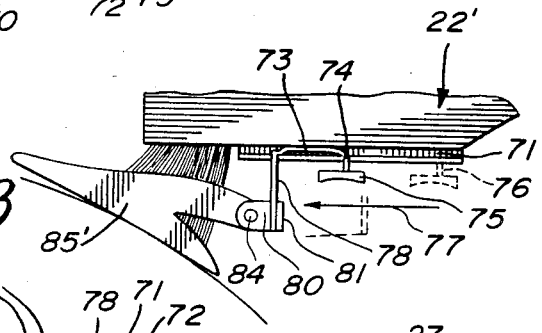
FIG. 13 is a partial side elevation showing another model and another position of the extension.
Figure 14:
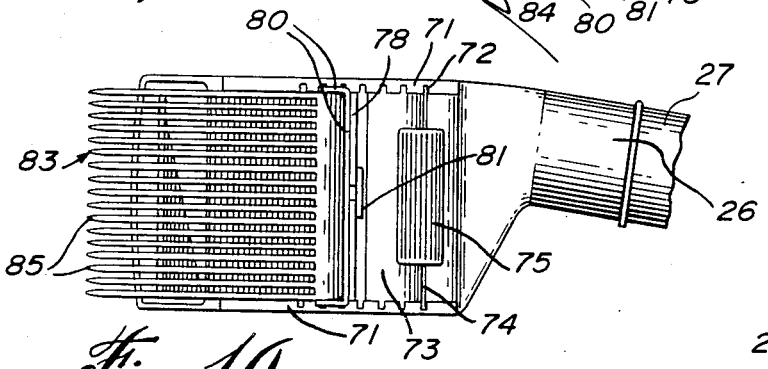
FIG. 14 is a bottom plan view of the arrangement of FIG. 13.

A comb structure 83 is pivoted at 84 to the side legs of the U-shape bracket 80 for pivotal movement towards and away from front wall 30. The comb structure 83 preferably consists of a plurality of teeth 85, each of flat blade construction, and arranged in spaced parallel relationship, each of generally triangular shape, with their wider portion adjacent the pivot 84. The wider portions of the teeth 85 are all interconnected, for instance by a through bolt formed by the pivot 84 with spacers between the teeth 85. Teeth 85 may have the shape such as shown in FIG. 12, or a shape such as shown at 85' in FIG. 13. The free edge of the teeth 85 or 85' is applied against the scalp; the hair is sucked into the chamber 51 and is cut by blades 44 and 46 to such a length as determined by the indexed position of the comb structure 83, longitudinally of the front wall 30, with the back edge of the teeth 85 abutting against the front wall 30. In this position, a generally uniform length of uncut hair is obtained. But if the user wants to vary the length of uncut hair as he moves the device along the client's scalp, he can vary the position of casing 22 about pivots 84 with the free edge of the teeth 85 still applied against the client's scalp, along arrow 87 and as shown in dotted line in FIG. 12, or in FIG. 13. Obviously, a progressively-increasing length of uncut hair can be obtained transversely of the passes made by the device along the client's scalp by transversely inclining the casing 22' with respect to the tooth structure 83, the latter being still applied against the client's scalp, this as as shown in FIG. 16. Adjustment of the uncut hair is also obtained by adjusting the position of the bracket 80 along support 78. If desired, the support 78 can be provided with side walls 86 for more effective pulling of the hair within chamber 51; but, obviously, this would restrict the effective pivotal movement of the comb structure 83, both along pivot 64 and pivot button 81.

Obviously, the air turbine 53 or 53' could be replaced by an electric motor for driving the crank arm 56.

What I claim is:

1. A suction type hair cutting device comprising, in combination, a closed box-like hollow casing having substantially parallel first and second walls and a third wall orthogonal to said first and second walls, a scissor-member and a fixed member mounted about a first aperture made in said first wall and through which hair is to be engaged and cut, said third wall having a second aperture with means for connection to a suction means for producing an air flow in between said first aperture and said second aperture, a shaft freely rotatably journalled in said casing first and second walls, vanes radially mounted to said shaft and in longitudinal registry with said second aperture, said shaft and vanes offset from said first aperture; and a link member pivotally interconnecting said scissor-member to said shaft, whereby rotation of said vanes under action of said air flow causes said link member to operatively actuate said scissor-member in its shearing action.

2. The cutting device as defined in claim 1, wherein said scissor-member and said fixed member are mounted interiorly of said casing first aperture.

3. A suction type hair cutting devic comprising a hand-carriable casing having an outlet adapted to be connected to a vacuum source and an intake adapted to be applied to the scalp to draw the hair thereof into the casing, said intake including an intake aperture of rectangular shape, and disposed in a plane substantially parallel to the outlet axis, a stationary blade fixed to said casing and extending along one longitudinal edge of said intake aperture and having a straight cutting edge facing the other longitudinal edge of said intake aperture, a movable blade, of elongated shape, pivoted at one end to said casing and extending in a plane parallel to that of said stationary blade and having a straight cutting edge adapted to progressively overlap and to coact with the straight cutting edge of said stationary blade during pivotal movement of said movable blade, said movable blade being disposed just inwardly of said intake aperture and partially closing the same, an air turbine including a shaft, freely rotatably mounted within said casing about an axis at right angles both to the axis of said outlet and to the plane defined by said intake aperture, and vanes radially projecting from said air turbine shaft and in longitudinal registry with said outlet, so as to be rotatable under the action of the flow of air sucked up from said casing by said vacuum source; a crank arm, pivoted to said turbine at one end eccentrically of said air turbine shaft and at the other end to the movable bade free end; whereby upon said vacuum source being actuated, the air turbine is brought into rotation and the crank arm reciprocates said movable blade between an open position, at least partially clearing said intake aperture, and a closed position closing said intake aperture and effecting scissor-like cutting of the hair between said cutting edges during this closing movement.

4. A suction type hair cutting device is claimed in claim 3, further including an intake extension member removably secured to said casing and in the form of a tubular duct opened at both ends and registering with said intake aperture when secured to said casing.

5. A suction type hair cutting device as defined in claim 4, further including additional intake extension members selectively securable to the casing in register with said intake aperture and differing from said first-named intake extension member by having a mouth spaced different distances from said intake aperture, and mouth-forming different inclinations with respect to said intake aperture.

6. A suction type hair cutting device as defined in claim 3, further including a semi-cylindrical partition wall extending through said casing and coaxial with said turbine surrounding the latter and defining an entrance chamber in communication with said intake aperture, said partition wall defining an air and hair passage between said entrance chamber and the portion of said casing containing said turbine.

7. A suction type hair cutting device as claimed in claim 3, further including an intake extension member removably secured to said casing and including a comb structure extending across said intake aperture and pivoted with respect to saiu casing for pivotal movement of said comb structure towards and away from said intake aperture.

* * * * *